US009523270B2

(12) United States Patent
Fripp et al.

(10) Patent No.: US 9,523,270 B2
(45) Date of Patent: Dec. 20, 2016

(54) DOWNHOLE ELECTRONICS WITH PRESSURE TRANSFER MEDIUM

(75) Inventors: Michael L. Fripp, Carrollton, TX (US); Donald G. Kyle, The Colony, TX (US); Orlando Dejesus, Frisco, TX (US); Roger Schultz, Ninnekah, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 390 days.

(21) Appl. No.: 13/120,796

(22) PCT Filed: Sep. 24, 2008

(86) PCT No.: PCT/US2008/077486

§ 371 (c)(1), (2), (4) Date: Mar. 24, 2011

(87) PCT Pub. No.: WO2010/036244

PCT Pub. Date: Apr. 1, 2010

(65) Prior Publication Data

US 2011/0168390 A1 Jul. 14, 2011

(51) Int. Cl.
*E21B 47/01* (2012.01)

(52) U.S. Cl.
CPC ..... *E21B 47/011* (2013.01)

(58) Field of Classification Search
USPC . 166/66, 250.07, 264, 302, 162; 175/40–42, 44–46, 48–50, 57–59, 60; 73/152.51–152.53, 299–303
See application file for complete search history.

(56) References Cited

U.S. PATENT DOCUMENTS 4,067,381 A * 1/1978 Lord ..... 165/11.1
4,407,136 A 10/1983 de Kanter
4,742,874 A * 5/1988 Gullion ..... 166/348
4,876,672 A * 10/1989 Petermann et al. ..... 367/35
4,932,471 A 6/1990 Tucker et al.
(Continued)

FOREIGN PATENT DOCUMENTS

EP 0677727 A2 10/1995

OTHER PUBLICATIONS

International Application No. PCT/US2008/077486 Search Report and Written Opinion dated Jun. 10, 2009.

*Primary Examiner* — Taras P Bemko
(74) *Attorney, Agent, or Firm* — Haynes and Boone, LLP

(57) ABSTRACT

Disclosed embodiments include apparatus and methods for transferring a pressure to downhole electronics with a pressure transfer medium. An embodiment of the apparatus includes a body supporting a moveable pressure transfer member, a pressure transfer medium contained by the body and the moveable pressure transfer member, and an electronic component disposed in the pressure transfer medium, wherein the pressure transfer member is moveable to transfer a pressure to the pressure transfer medium and the electronic component. Another embodiment of the apparatus includes a moveable enclosure and a non-conductive material, wherein the non-conductive material isolates an electronic component from a downhole fluid and the moveable enclosure is operable to transfer a hydrostatic pressure to the non-conductive material and the electronic component. An embodiment of a method includes transferring a downhole hydrostatic pressure to an electronic component via a flexible package and a pressure transfer medium.

8 Claims, 6 Drawing Sheets

(56) References Cited

U.S. PATENT DOCUMENTS

| | | | | |
|---|---|---|---|---|
| 5,070,595 | A | 12/1991 | Perkins et al. | |
| 5,932,332 | A * | 8/1999 | Pandorf et al. | 428/220 |
| 6,089,106 | A | 7/2000 | Patel et al. | |
| 6,105,690 | A | 8/2000 | Biglin, Jr. et al. | |
| 6,131,658 | A | 10/2000 | Minear | |
| 6,331,438 | B1 * | 12/2001 | Aylott et al. | 436/172 |
| 6,443,226 | B1 | 9/2002 | Diener et al. | |
| 6,915,686 | B2 | 7/2005 | Baustad | |
| 7,140,434 | B2 | 11/2006 | Chouzenoux et al. | |
| 7,278,480 | B2 | 10/2007 | Longfield et al. | |
| 2001/0054514 | A1 | 12/2001 | Sullivan et al. | |
| 2002/0053242 | A1 * | 5/2002 | Tai et al. | 73/754 |
| 2003/0019621 | A1 * | 1/2003 | Schultz et al. | 166/65.1 |
| 2003/0056947 | A1 | 3/2003 | Cameron | |
| 2004/0060359 | A1 | 4/2004 | Wilson | |
| 2004/0134667 | A1 | 7/2004 | Brewer et al. | |
| 2004/0144541 | A1 | 7/2004 | Picha et al. | |
| 2004/0154390 | A1 * | 8/2004 | Baustad | 73/152.55 |
| 2005/0263290 | A1 | 12/2005 | Zazovsky et al. | |
| 2006/0090892 | A1 | 5/2006 | Wetzel et al. | |
| 2006/0132792 | A1 * | 6/2006 | Schultz et al. | 356/480 |
| 2007/0062695 | A1 | 3/2007 | Harrison et al. | |
| 2007/0222109 | A1 * | 9/2007 | Pfenniger et al. | 264/241 |

* cited by examiner

DOWNHOLE ELECTRONICS WITH PRESSURE TRANSFER MEDIUM

CROSS-REFERENCE TO RELATED APPLICATION

This application is the U.S. National Stage under 35 U.S.C. §371 of International Patent Application No. PCT/US2008/077486 filed Sep. 24, 2008, "Downhole Electronics With Pressure Transfer Medium."

STATEMENT REGARDING FEDERALLY SPONSORED RESEARCH OR DEVELOPMENT

Not applicable.

BACKGROUND

During the drilling and completion of oil and gas wells, it may be necessary to engage in ancillary operations, such as evaluating the production capabilities of formations intersected by the wellbore. For example, after a well or well interval has been drilled, zones of interest are often tested to determine various formation properties such as permeability, fluid type, fluid quality, fluid density, formation temperature, formation pressure, bubble point, formation pressure gradient, mobility, filtrate viscosity, spherical mobility, coupled compressibility porosity, skin damage (which is an indication of how the mud filtrate has changed the permeability near the wellbore), and anisotropy (which is the ratio of the vertical and horizontal permeabilities). These tests are performed in order to determine whether commercial exploitation of the intersected formations is viable and how to optimize production.

Tools for evaluating formations and fluids in a well bore may take a variety of forms, and the tools may be deployed downhole in a variety of ways. For example, the evaluation tool may include a formation tester having an extendable sampling device, or probe, and pressure sensors. The evaluation tool may include a fluid identification (ID) system with sampling chambers or bottles. The tool may be conveyed downhole on a wireline. Often times an evaluation tool is coupled to a tubular, such as a drill collar, and connected to a drill string used in drilling the borehole. Thus, evaluation and identification of formations and fluids can be achieved during drilling operations with measurement while drilling (MWD) or logging while drilling (LWD) tools. The several components and systems just described are suitable for various combinations as one of skill in the art would understand.

Downhole operation or evaluation systems often require electronics or electronic devices to fully function. Downhole hydrostatic pressures can reach 10,000 psi, and sometimes up to 20,000 psi or above. Therefore, it is well known that the sensitive electronics must be disposed in a pressure housing or vessel to shield the electronics from the downhole pressures, thereby avoiding damage. The pressure vessel also protects the electronics from corrosive and conductive fluids in the downhole environment. Such a pressure vessel may use O-ring seals coupled to a pressure housing, with iconel used to maintain a rigid vessel and good seal surfaces while in a corrosive environment. The pressure vessel creates a significant pressure differential inside the downhole tool. Such pressure vessels increase the complexity and expense of the downhole tool, and use valuable space in the constrained downhole tool.

BRIEF DESCRIPTION OF THE DRAWINGS

For a detailed description of exemplary embodiments of the invention, reference will now be made to the accompanying drawings in which.

DETAILED DESCRIPTION

Figure 1:
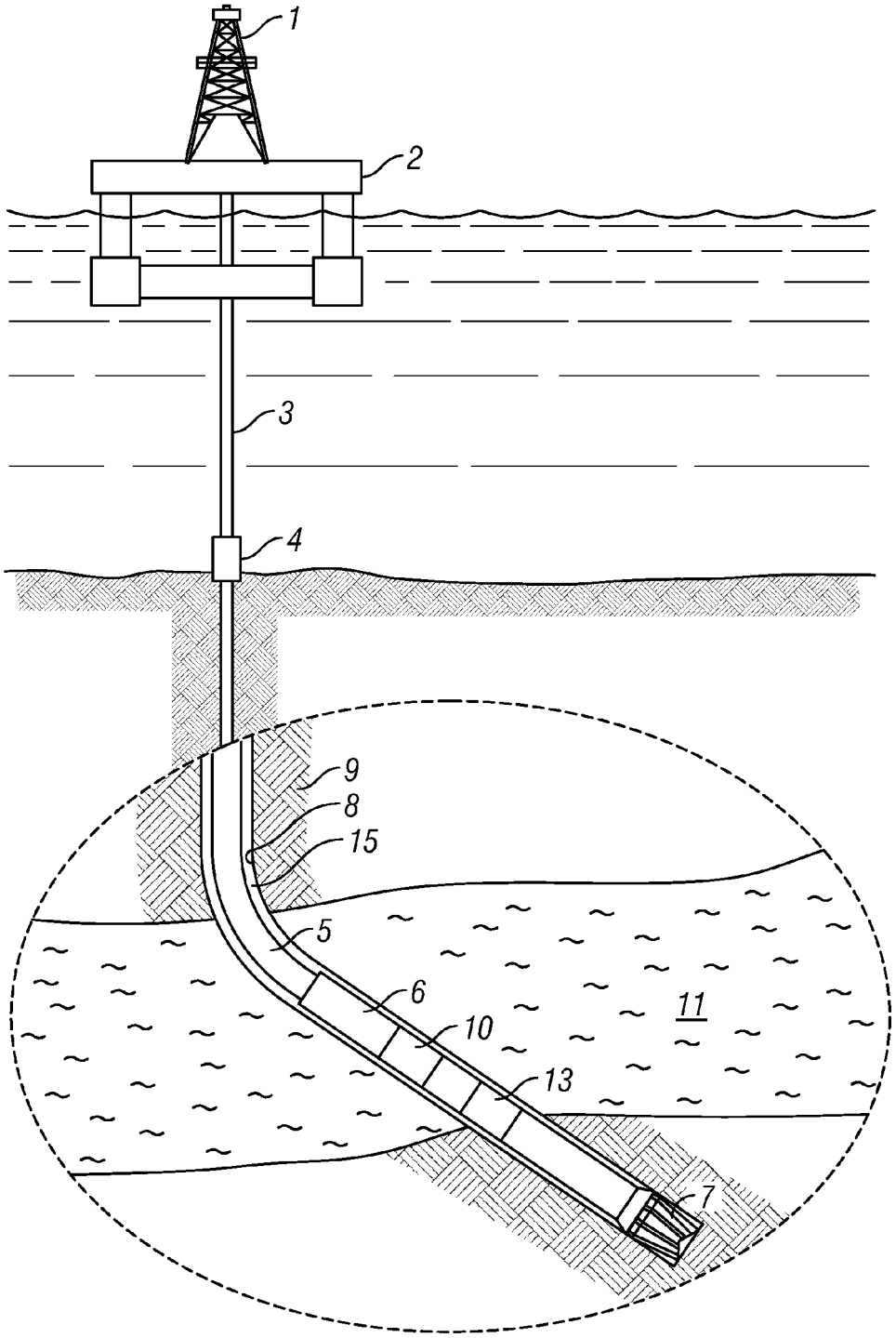
FIG. 1 is a schematic elevation view, partly in cross-section, of an embodiment of a drilling and MWD apparatus disposed in a subterranean well.

In the drawings and description that follow, like parts are typically marked throughout the specification and drawings with the same reference numerals. The drawing figures are not necessarily to scale. Certain features of the invention may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results.

Unless otherwise specified, any use of any form of the terms "connect", "engage", "couple", "attach", or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up", "upper", "upwardly" or "upstream" meaning toward the surface of the well and with "down", "lower", "downwardly" or "downstream" meaning toward the terminal end of the well, regardless of the well bore orientation. In addition, in the discussion and claims that follow, it may be sometimes stated that certain components or elements are in fluid communication. By this it is meant that the components are constructed and interrelated such that a fluid could be communicated between them, as via a passageway, tube, or conduit. Also, the designation "MWD" or "LWD" are used to mean all generic measurement while drilling or logging while drilling apparatus and systems. The various characteristics mentioned above, as well as other features and characteristics described in more detail below, will be readily apparent to those skilled in the art upon reading the following detailed description of the embodiments, and by referring to the accompanying drawings.

Unless otherwise noted, the term "downhole electronics" means digital electronics, signal-conditioning electronics, communication electronics, processing electronics, circuit boards, capacitors, resistors, inductors, transistors, oscillators, resonators, semiconductor chips, processors, memory chips, power supplies, primary batteries, secondary batteries, and the like.

Referring initially to FIG. 1, a drilling apparatus including electronic components is shown. A downhole electronic tool 10, such as a formation tester, formation fluid identification tool, MWD tool, LWD tool, logging tool, drilling sonde, tubing-conveyed tool, wireline tool, slickline tool, completion tool or other electronic tool, is shown enlarged and schematically as a part of a bottom hole assembly 6 including a sub 13 and a drill bit 7 at its distal most end. The bottom hole assembly 6 is lowered from a drilling platform 2, such as a ship or other conventional land platform, via a drill string 5. The drill string 5 is disposed through a riser 3 and a well head 4. Conventional drilling equipment (not shown) is supported within a derrick 1 and rotates the drill string 5 and the drill bit 7, causing the bit 7 to form a borehole 8 through formation material 9. The drill bit 7 may also be rotated using other means, such as a downhole motor. The borehole 8 penetrates subterranean zones or reservoirs, such as reservoir 11, that are believed to contain hydrocarbons in a commercially viable quantity. An annulus 15 is formed thereby. It is also consistent with the teachings herein that the electronic tool 10 is employed in other bottom hole assemblies and with other drilling apparatus in land-based drilling with land-based platforms, as well as offshore drilling as shown in FIG. 1. In all instances, in addition to the electronic tool 10, the bottom hole assembly 6 contains various conventional apparatus and systems, such as a down hole drill motor, a rotary steerable tool, a mud pulse telemetry system, MWD or LWD sensors and systems, and others known in the art. In some embodiments, the electronic tool 10 is a remote module, untethered to the surface of the well. In some embodiments, the electronic tool 10 is under water but at a well head of the well, such that the electronics are in a hydrostatic environment without being subterranean.

Figure 2:
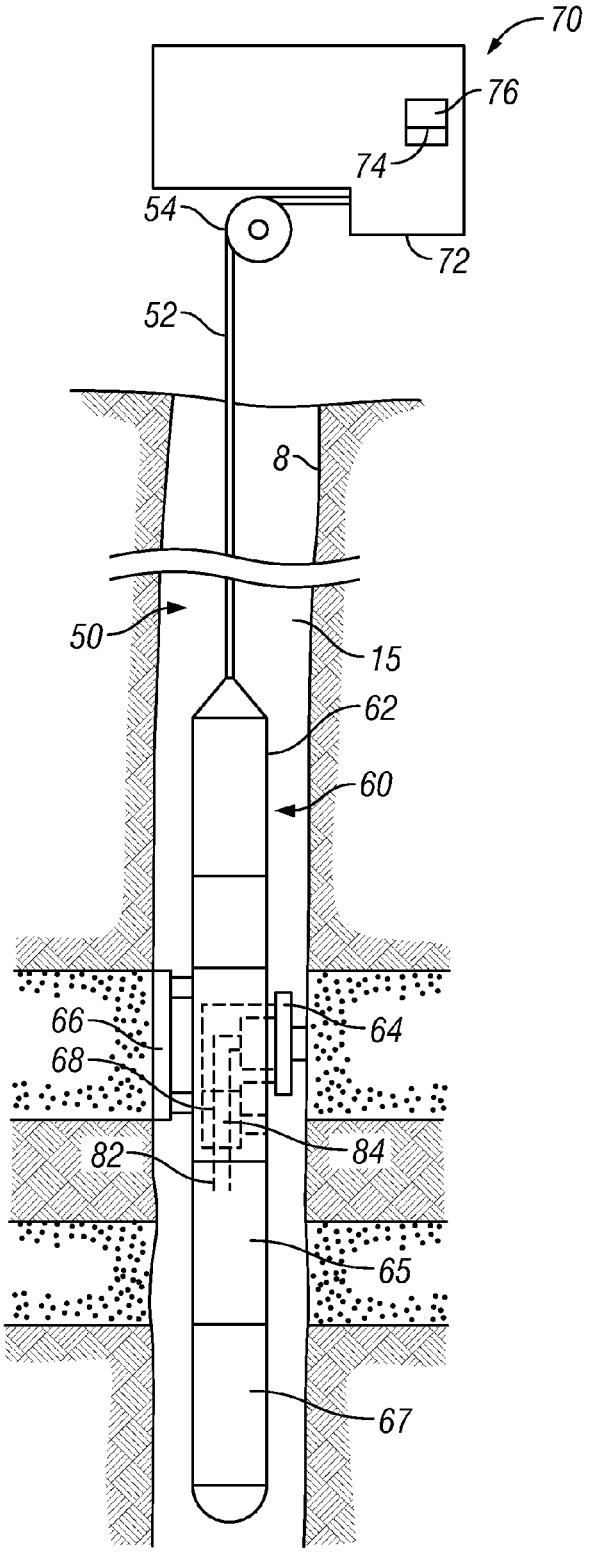
FIG. 2 is a schematic elevation view, partly in cross-section, of an embodiment of a wireline apparatus disposed in a subterranean well.

In some embodiments, and with reference to FIG. 2, an electronic tool 60 is disposed on a tool string 50 conveyed into the borehole 8 by a cable 52 and a winch 54. The electronic tool includes a body 62, a sampling assembly 64, a backup assembly 66, analysis modules 68, 84 including electronic devices, a flowline 82, a battery module 65, and an electronics module 67. The electronic tool 60 is coupled to a surface unit 70 that may include an electrical control system 72 having an electronic storage medium 74 and a control processor 76. In other embodiments, the tool 60 may alternatively or additionally include an electrical control system, an electronic storage medium and a processor.

Figure 3:
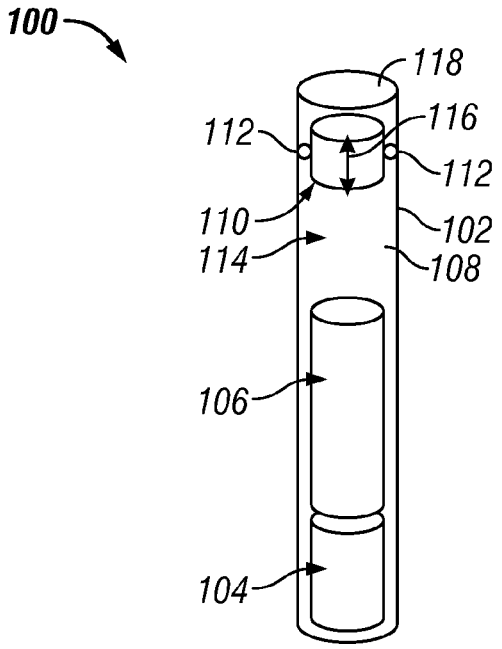
FIG. 3 is a schematic elevation view, partly in cross-section, of an embodiment of a pressure transfer packaging for downhole electronics.

Referring now to FIG. 3, an elevation and schematic view of an electronics component 100 of an electronic tool 10 is shown. The electronics component 100 is packaged without the need for a rigid pressure vessel. A packaging or housing 102 contains an electronic device or module 104, a battery 106, a cavity 108 and a piston 110. The electronics module includes known electronic devices such as those described more specifically herein. The battery 106 is a power source for the electronic devices. The cavity is filled with a quantity of a pressure or load transfer medium 114. In some embodiments, the pressure transfer medium is a bath of liquid. In exemplary embodiments, the pressure transfer medium is a mineral oil, a silicon oil, a hydraulic fluid, a water-based fluid, an alcohol-based fluid, an oil-based fluid, a polyglycol, a triol, a polyol, or other non-conductive and benign fluids.

The pressure transfer medium 114 is disposed between the battery 106 and the piston 110. In the embodiment shown, the piston 110 is disposed above the pressure transfer medium. The piston 110 is moveable in the housing 102. As shown by arrow 116, the piston is axially moveable while a seal 112 seals the cavity 108 from the well fluids or conductive brines 118 abutting the other side of the piston 110. The piston 110 may also be referred to as a floating piston. The floating piston 110 will move according to the pressure differential across the piston 110 caused by the hydrostatic pressure in the fluids 118. In this manner, the piston 110 transfers the hydrostatic pressure of the outside well fluids 118 into the pressure transfer medium 114. The hydrostatic pressure also surrounds the housing 102. As a result, there is very little pressure differential across the walls of the housing 102. Consequently, the housing 102 can be made of a material much less rigid than a pressure vessel. In exemplary embodiments, the housing 102 comprises a thin metal. In exemplary embodiments, the housing 102 comprises a polymeric material.

In other embodiments, the floating piston 110 is replaced with a moveable baffle or a moveable bladder that operates to transfer the hydrostatic pressure of the fluids 118 into the packaging 100 and minimize the pressure differential across the housing 102. In other embodiments, other moveable pressure transfer members or barriers are disposed in the housing or packaging to interact with the pressure transfer medium as described herein.

In further embodiments, the moveable pressure transfer member is a flexible housing sealing therein both the pressure transfer medium and the electronics. For example, with reference to FIG. 4, an electronics component 200 of a downhole electronics tool is shown in a schematic cross-section, with the section taken in a radial plane of the component such as the tool 10 in FIG. 1 or the electronics module 67 of FIG. 2. The electronics component 200 includes a body 202 having one or more cavities 204, 206, 208. In some embodiments, the body 202 is an annular shape as shown, while in other embodiments the body takes the shape of other downhole tools and instruments, such as cylindrical.

The first cavity 204 contains a power source or battery 212 and a circuit board 216 supporting electronics 214. The battery 212 and the circuit board 216 are coupled by a conduit 218. The battery 212, circuit board 216 and electronics 214 are surrounded by a pressure transfer medium 224. In some embodiments, the pressure transfer medium 224 fills the cavity 204. In exemplary embodiments, the pressure transfer medium 224 is a non-conductive potting material. In exemplary embodiments, the non-conductive potting material comprises a two-part epoxy, a one-part epoxy, a rubber material, an elastomeric material, a wax material, a thermoplastic material, a viscoelastic material, a molten salt, or a paint, or various combinations thereof. The pressure transfer medium 224 separates the electronics 214 and the battery 212 from the conductive well bore fluids flowing therearound. The opening of the cavity 204 faces the inside 204 of the body 202, thus making the cavity 204 an internal cavity. The exposed medium 224 at the opening is covered or enclosed by a thin shield 220. In exemplary embodiments, the enclosure shield 220 comprises metal. The shield 220 may provide abrasion protection from tool passage or from abrasive slurries. The shield 220 moves or flexes to interact with the pressure transfer medium 224 and transfers the hydrostatic pressure load to the electronics 214 and the battery 212. The internal geometry of the cavity 204 may include variable axial, circumferential and radial lengths depending on the size of the electronics and the battery, and it may include a divider or barrier 222.

The second cavity 208 is comparable to the first cavity 204, except that the second cavity 208 is an alternative external cavity wherein the opening faces outward of the body 202. The cavity 208 includes a battery 232, a circuit 236, electronics 234, a connecting wire 238, a pressure transfer medium 244, and a moveable or flexible enclosure member 240. The pressure transfer medium 244, such as a non-conductive potting material, again isolates the electronics and battery from the well bore fluids. The second cavity 208 may also include variable length geometries and a divider or structural reinforcement member 242.

The third cavity 206 is yet another embodiment of an apparatus for transferring downhole hydrostatic pressure to downhole electronics. The cavity 206 contains a circuit board 256 supporting electronics 254. In some embodiments, the cavity 206 also contains a battery. A flexible enclosure 260 encloses the circuit 256 and electronics 254. The enclosure 260 is filled with a pressure transfer medium 264 that surrounds the circuit 256 and electronics 254. In some embodiments, the pressure transfer medium 264 comprises a mineral oil or an equivalent fluid. The flexible enclosure 260 is sealed to prevent the conductive well bore fluids from interacting with the electronics 254. The enclosure 260 is a moveable barrier that moves or flexes to transfer hydrostatic pressure between the wellbore and the pressure transfer medium 264 and ultimately the electronics 254. In exemplary embodiments, the flexible enclosure 260 comprises a metalized polymer enclosure, similar to the enclosure around a polymer battery. In exemplary embodiments, the flexible enclosure 260 is rigidly mounted to the cavity 206. In alternative exemplary embodiments, the flexible enclosure floats within the cavity 206 and is retained by the barrier 266. A more flexible retention between the electronics 254 in the enclosure 260 and the tool string 202 may better isolate the electronics 254 from vibrations and shocks caused by drilling operations.

The moveable barrier or flexible enclosure of the various electronics packages described above lessens the density of the electronics package. A light-weight plastic housing, or a thin enclosure, reduces density. The pressure transfer media, such as a low-density mineral oil or other fluid, also reduces density. Consequently, the overall electronics package (or tool) can be neutral density across a wide range of hydrostatic pressures.

Figure 4:
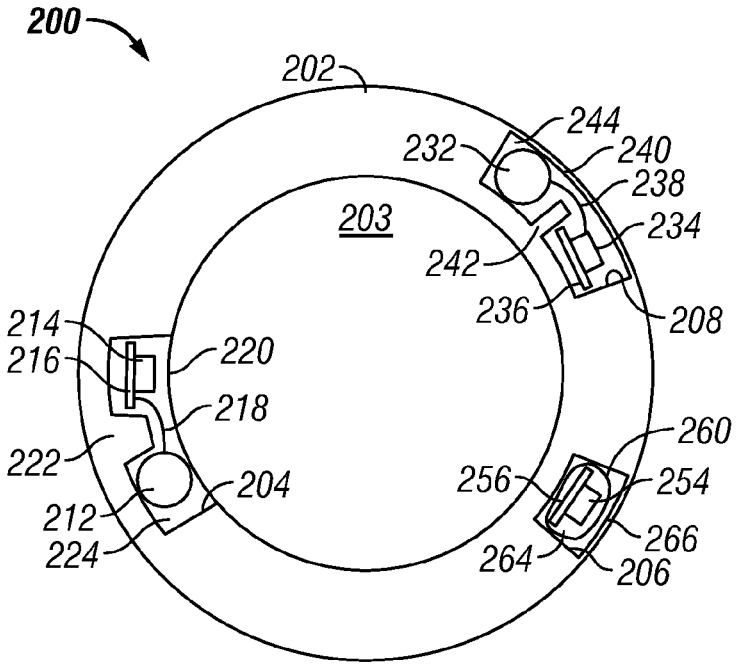
FIG. 4 is a schematic cross-section view of another embodiment of a pressure transfer packaging for downhole electronics.
Figure 5A:
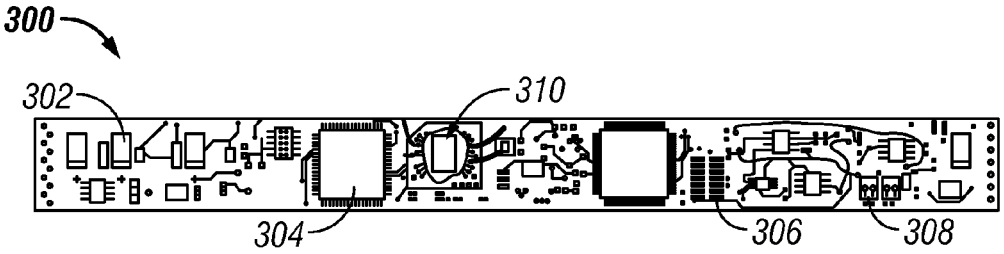
FIG. 5A is a schematic top view of an embodiment of a printed circuit board with a localized pressure housing.
Figure 5B:
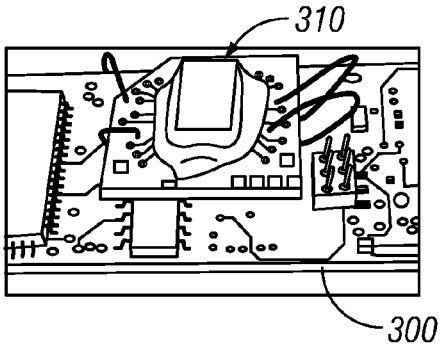
FIG. 5B is an enlarged view of the localized pressure housing of FIG. 5A.

While many downhole electronics can be exposed to hydrostatic pressure via a pressure transfer medium contained in a moveable enclosure or barrier, some ultra sensitive electronics devices may require a localized pressure housing. Referring now to FIG. 5A, a top view of a printed circuit board (PCB) 300 supporting a variety of electronic devices and components 302, 304, 306, 308 is shown. The circuit board and electronics combination as shown in FIG. 4 are comparable to the electronics 104 of FIG. 3 and the electronics 214/216, 234/236 and 254/256 of FIG. 4. However, in some embodiments, a localized pressure housing 310 is disposed over a sensitive electronic device. An enlarged view of the localized pressure housing 310 is shown in FIG. 5B, while the electronic component or chip 312 needing added pressure protection is shown in the schematic and cross-section view of FIG. 5C.

Figure 5C:
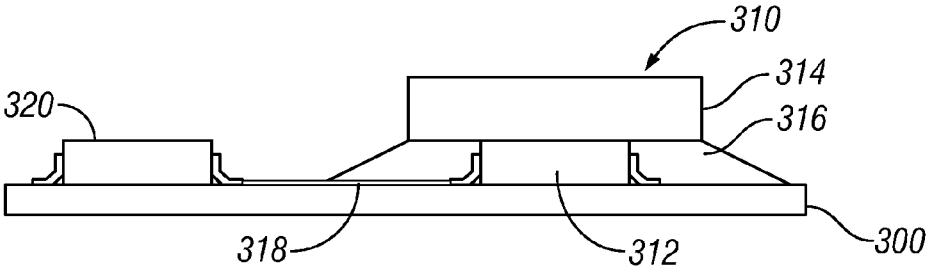
FIG. 5C is a cross-section view of the localized pressure housing of FIGS. 5A and 5B.

Still referring to FIG. 5C, the chip 312 may comprise an interior air volume that is highly sensitive to pressure. Exposure to the high hydrostatic pressures of the downhole environment will crush the chip 312. In some embodiments, the chip 312 is an oscillator or a resonator. The presence of such chips on the PCB 300 does not mean the entire PCB 300 must be placed in a pressure vessel. The embodiments described with reference to FIGS. 3 and 4 can be modified to include a localized pressure housing over the chip 312. As shown in FIG. 5C, the chip 312 is supported by the PCB 300. A barrier or enclosure 314 is disposed over the chip 312. The enclosure 314 must provide a rigid pressure barrier, thus in some embodiments the enclosure 314 is a metal roof. In other exemplary embodiments, the enclosure 314 comprises composites, ceramics, or combinations thereof. In some embodiments, the enclosure 314 includes different shapes, such as curves or angles. In some embodiments, the enclosure 314 includes mechanical reinforcement with the PCB 300. In certain embodiments, the enclosure 314 encloses multiple sides of the chip 312. In other embodiments, the enclosure 314 completely surrounds the chip 312.

To seal the enclosure 314 around the chip 312 and onto the PCB 300, a sealing agent 316 is applied. In some embodiments, the sealing agent comprises an epoxy. In some embodiments, a welded box replaces a sealed roof. The completed assembly includes a first pressure member 314 opposed by another pressure member 300 on the other side of the chip 312. The PCB 300, or any other member, may include a reinforcing member. Disposed adjacent the pressure-protected chip 312 is an electronic component 320 not needing pressure protection, and is instead exposed to the downhole hydrostatic pressure in the manners described with reference to FIGS. 3 and 4 and elsewhere herein. The chip 312 may be electrically connected to the electronic component 320 by a trace 318, which is a conductive pathway etched from copper sheets. The trace 318 may be laminated onto a non-conductive substrate to form the circuit board 300.

In some embodiments, other forms of a localized pressure housing may enclose the pressure-sensitive chip 312, such that the entire circuit board is not pressure-housed and the localized pressure housing does not significantly increase the footprint or cost of the overall electronics package with the pressure transfer medium. In exemplary embodiments, multiple pressure-sensitive chips 312 may be disposed on the PCB 300 in close proximity to one another such that a single local pressure housing more easily encloses multiple chips.

Downhole electronic components or chips disposed in a pressure vessel with an air-filled chamber are essentially thermally insulated by the air chamber. The air chamber does not allow for easy transfer of the chip-generated heat into the surrounding environment. The chip-generated heat is a significant cause for electronics failure due to high temperatures. In the embodiments described herein, the pressure transfer medium coupled to the electronic heat-generating components also functions as a heat transfer medium, increasing the heat rejection from the electronic components to the downhole environment. In some embodiments, other heat transfer fluids are used that still function as non-conductive pressure transfer media.

Figure 6:
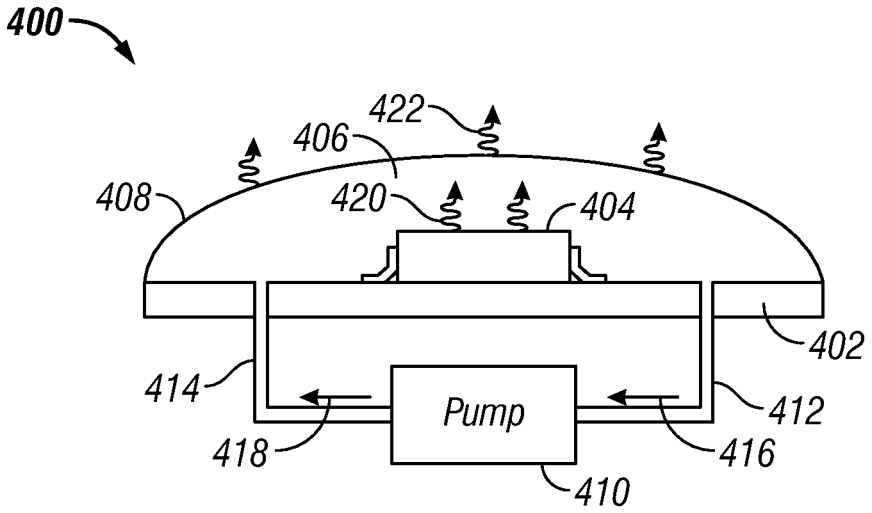
FIG. 6 is a schematic cross-section view of an embodiment of a circulation system for a pressurized transfer medium and electronic component.

In some embodiments, the heat transfer from the downhole electronics is further increased by circulating the medium coupled to the electronics. For ease and clarity of description, the medium coupled to the electronics is a mineral oil. Referring now to FIG. 6, a circulation system 400 is shown schematically. The system 400 includes a circuit board 402 supporting an electronic component or chip 404. The chip 404 is directly coupled to and surrounded by a mineral oil bath 406 contained by a flexible enclosure 408, consistent with teachings elsewhere herein. The circuit board 402 is provided with an outlet flow path 412 coupled to a pump 410 and an inlet flow path 414 coupled to the pump 410.

During operation, the chip 404 generates heat, which makes the chip hotter than the downhole temperature. In many wells for downhole energy production, the temperature is over 100° C. Furthermore, the heated chip, circuit board and connections emit gases caused by the heat (also called outgases). The outgases tend to negatively react with the electronics and their packaging. The mineral oil, pressurized by the hydrostatic well pressure, will be at a higher pressure than the vapor pressure of the outgases. Thus, the pressurized transfer medium prevents outgassing from occurring. In some embodiments, the outgassing may include water being transformed into steam. In that case, the pressure applied to the electronic component will be higher than the vapor pressure of the water to prevent the outgassing of the water to steam. This may prevent thermal cycling of the water from depositing the water in other, more harmful places in the tool packaging. In exemplary embodiments, the outgases are soluble in the pressure transfer medium and, thus, are prevented from condensing on critical electronic components.

Heat may also be moved in the system 400. The conductance of the pressure transfer medium increases thermal conduction away from the electronics. The thermal gradient of the pressure transfer medium will also establish natural convection patterns that aid heat transfer. In some embodiments, thermal convection is increased by actively applying a force to the pressure transfer medium, such as mineral oil. For example, the pump 410 can be periodically actuated, or, alternatively, operated continuously, to draw mineral oil into the flow path 412 and out of the oil bath 406. The pump 410 then injects the oil back into the oil bath 406 through the flow path 414. An inward flow 416 and an outward flow 418 through the pump 410 circulate the mineral oil over the heat-generating chip 404. The circulating mineral oil carries heat away from the chip 404 to cool it, allowing the chip 404 to operate at high downhole environment temperatures that might ordinarily cause the chip to fail. The heat rejection or dissipation from the chip at 420 and from the flexible enclosure at 422 are increased by the circulated mineral oil.

In some embodiments, the mineral oil of FIG. 6 is additionally circulated through a heat exchanger to transfer more heat. In other embodiments, the mineral oil is additionally circulated through a powered refrigerator. In some embodiments, the mineral oil is additionally circulated through a phase-change material. These embodiments provide additional means for heat exchanging. As previously noted, the circulated fluid may be other heat transfer fluids than mineral oil.

Figure 7:
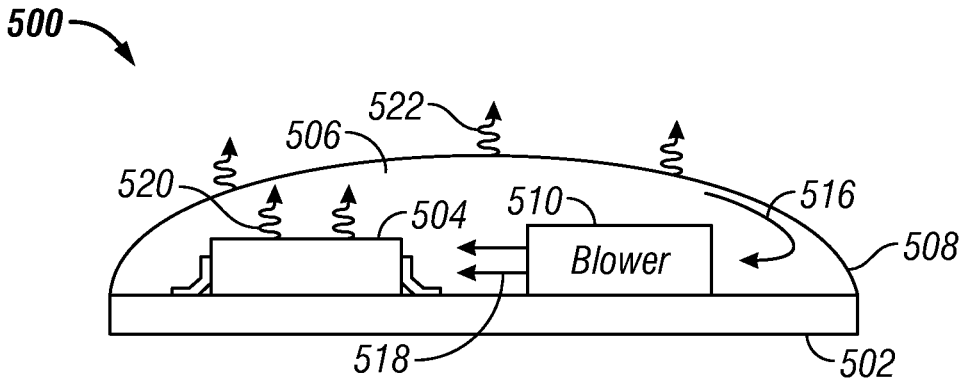
FIG. 7 is a schematic cross-section view of another embodiment of a circulation system for a pressurized transfer medium and electronic component.

Referring now to FIG. 7, another embodiment of a circulation system 500 is shown schematically. The system 500 includes a board 502 supporting a chip 504. A mineral oil bath 506 is coupled to the chip 504 and contained by the flexible enclosure 508. A pump or blower 510 is disposed inside of the enclosure 508, adjacent to the chip 504 and also coupled to the mineral oil bath 506. The blower 510 is actuated, or alternatively operated continuously, to create a fluid flow 516, 518 that circulates the mineral oil over the chip 504 and increases heat dissipation 520, 522. In some embodiments, the system 500 may further include the heat exchangers and refrigerators described above.

Figure 8A:
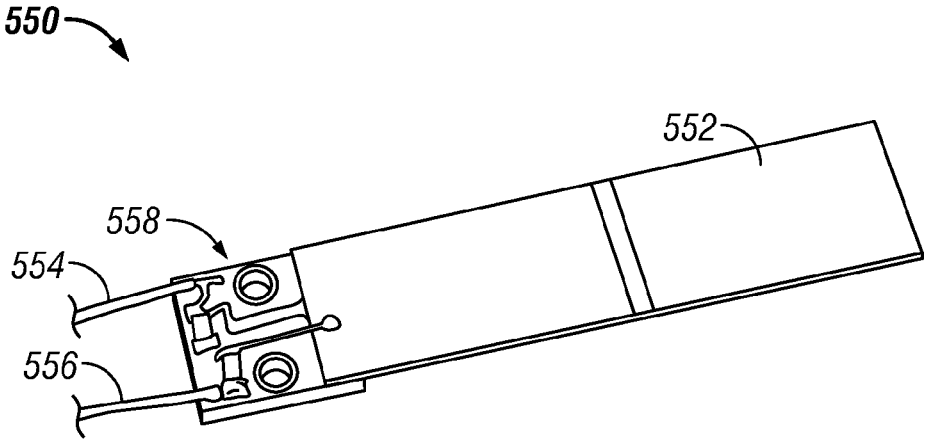
FIG. 8A is an isometric view of an embodiment of a flexible blade oscillating blower.
Figure 8B:
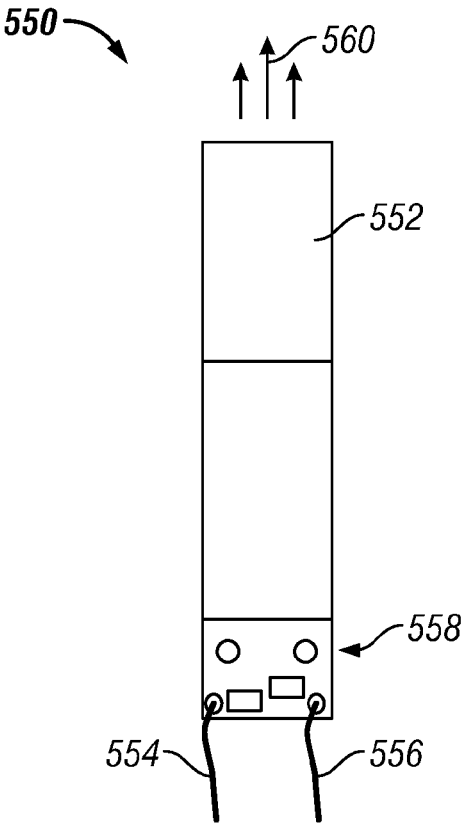
FIG. 8B is a top view of the flexible blade oscillating blower of FIG. 8A.
Figure 8C:
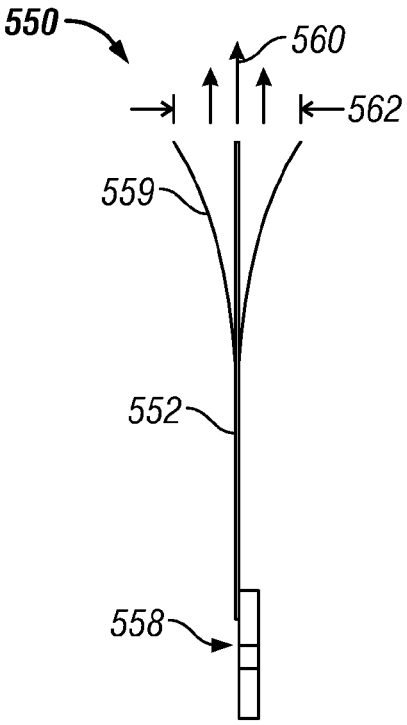
FIG. 8C is a side view of the flexible blade oscillating blower of FIGS. 8A and 8B.

In some embodiments, the blower 510 comprises an oscillating flexible blade. In some embodiments, the blower 510 comprises an oscillating blade manufactured by Piezo-Systems. With reference to FIG. 8A, an isometric view of a flexible oscillating blade system 550 is shown. A blade 552 includes a base 558 with a drive means and electrical couplings 554, 556. FIGS. 8B and 8C are front and side views of the blade 552 showing that the oscillating end 559 of the blade 552 creates a blade swing 562 and a fluid flow 560. As previously described, the fluid flow 560 convects heat away from the electronics and reduces the temperature rise caused by the self-heating electronics. The blade system 550 is a small, solid-state component that operates for a large number of cycles. For example, it has been demonstrated that the blade system 550 continues to operate after 13,000,000,000 cycles.

In some embodiments, the systems 400, 500 include a pressurized fluid in the baths 406, 506 consistent with the teachings herein, wherein the fluids are pressurized by the flexible enclosures 408, 508 that transfer the hydrostatic pressure of the surrounding downhole environment.

The moveable or flexible pressure-transfer enclosures or other housings of the embodiments described herein are reciprocal such that they provide pressure equalization or balancing between the well fluid pressure and the electronics during all changes in the well pressure. Such pressure balancing with the enclosure also accounts for movement or fluctuations due to thermal expansion.

The embodiments disclosed relate to apparatus and methods for applying a downhole pressure to downhole electronics. In some embodiments, the apparatus and methods include a flexible enclosure and a pressure transfer medium for applying a hydrostatic downhole pressure to the downhole electronics, but the concepts of the disclosure are susceptible to use in embodiments of different forms. There are shown in the drawings, and herein described in detail, specific embodiments of the present disclosure with the understanding that the present disclosure is to be considered an exemplification of the principles of the disclosure, and is not intended to limit the disclosure to that illustrated and described herein. In particular, various embodiments of the present disclosure provide a number of different moveable or flexible enclosures and pressure and/or heat transfer media for transferring the hydrostatic pressure to the electronics. It is to be fully recognized that the different teachings of the embodiments discussed herein may be employed separately or in any suitable combination to produce desired results.

The embodiments set forth herein are merely illustrative and do not limit the scope of the disclosure or the details therein. It will be appreciated that many other modifications and improvements to the disclosure herein may be made without departing from the scope of the disclosure or the inventive concepts herein disclosed. Because many varying and different embodiments may be made within the scope of the inventive concept herein taught, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A downhole apparatus, comprising:

a body disposed in a downhole fluid with a hydrostatic pressure;

a cavity positioned along the body, wherein a barrier is positioned over the cavity;

a flexible enclosure positioned inside the cavity;

a pressure transfer medium positioned inside the flexible enclosure; and an electronic component positioned in the pressure transfer medium, wherein the flexible enclosure:

completely surrounds the pressure transfer medium and the electronic component;

isolates the electronic component from the downhole fluid; and transfers the hydrostatic pressure to the electronic component via the pressure transfer medium.

2. A downhole apparatus as defined in claim 1, wherein:

the body is a tubular having an inner and outer surface; and the barrier is positioned adjacent the outer surface.

3. A downhole apparatus as defined in claim 1, wherein:

the body is a tubular having an inner and outer surface; and the barrier is positioned adjacent the inner surface.

4. A downhole apparatus as defined in claim 1, wherein the pressure transfer medium comprises any one or more of a mineral oil, a silicon oil, a hydraulic fluid, a water-based fluid, an alcohol-based fluid, an oil-based fluid, a polyglycol, a triol and a polyol.

5. A downhole apparatus as defined in claim 1, wherein the electronic component comprises at least one of a digital electronics, signal-conditioning electronics, communication electronics, processing electronics, a circuit board, a capacitor, a resistor, an inductor, a transistor, an oscillator, a resonator, a semiconductor chip, a processor, a memory chip, a power supply, a primary battery or a secondary battery.

6. A downhole apparatus as defined in claim 1, wherein the electronic component is operable for downhole energy production.

7. A downhole apparatus as defined in claim 1, wherein the electronic component is operable at greater than 100° C.

8. A method for pressurizing an electronic component as defined in any one of claims 1-7, comprising:

deploying the apparatus downhole;

exposing the flexible enclosure to hydrostatic pressure; and transferring the hydrostatic pressure to the electronic component via the pressure transfer medium.

* * * * *